US008997673B1

(12) United States Patent
Moseley

(10) Patent No.: US 8,997,673 B1
(45) Date of Patent: Apr. 7, 2015

(54) POWER BOAT EMERGENCY FLOATATION DEVICE

(71) Applicant: Steve G. Moseley, Hialeah, FL (US)

(72) Inventor: Steve G. Moseley, Hialeah, FL (US)

( * ) Notice: Subject to any disclaimer, the term of this patent is extended or adjusted under 35 U.S.C. 154(b) by 0 days.

(21) Appl. No.: 14/067,010

(22) Filed: Oct. 30, 2013

(51) Int. Cl.
*B63B 43/10* (2006.01)
*B63B 43/14* (2006.01)

(52) U.S. Cl.
CPC ..... *B63B 43/14* (2013.01)

(58) Field of Classification Search
USPC ..... 114/68, 69
IPC ..... B63B 2043/145
See application file for complete search history.

(56) References Cited

U.S. PATENT DOCUMENTS 3,909,777 A * 9/1975 Baba et al. ..... 180/274
D293,778 S 1/1988 Curbow
4,864,961 A 9/1989 Slonski
5,357,888 A 10/1994 Insinna
5,860,379 A 1/1999 Moody
6,218,616 B1 * 4/2001 Bates et al. ..... 174/66
6,435,125 B2 * 8/2002 Mears ..... 114/360
6,550,415 B2 4/2003 Lloveres
D477,559 S 7/2003 Hovland
6,598,550 B1 7/2003 Patel
7,644,673 B2 * 1/2010 Schmitt ..... 114/68

* cited by examiner

*Primary Examiner* — Stephen Avila

(57) ABSTRACT

A power boat emergency floatation device deploys from a power boat to inhibit sinking of the power boat. The device includes a boat having a hull. The hull has an upper edge extending around the boat. Each of a plurality of cavities extends into the hull of the boat. The cavities are positioned in spaced arrangement around the hull of the boat. Each of a plurality of inflatable bladders is positioned in an associated one of the cavities. Each inflatable bladder is coupled to the hull of the boat and is selectively inflatable wherein the inflatable bladders inhibit sinking of the boat when the inflatable bladders are inflated and extended from the hull. A trigger mechanism is operationally coupled to each inflatable bladder wherein actuation of the trigger mechanism deploys each inflatable bladder from the associated cavity and inflates each inflatable bladder.

10 Claims, 5 Drawing Sheets

POWER BOAT EMERGENCY FLOATATION DEVICE

BACKGROUND OF THE DISCLOSURE

1. Field of the Disclosure

The disclosure relates to emergency floatation devices and more particularly pertains to a new emergency floatation device for deploying from a power boat to inhibit sinking of the power boat.

2. Summary of the Disclosure

An embodiment of the disclosure meets the needs presented above by generally comprising a boat having a hull. The hull has an upper edge extending around the boat. Each of a plurality of cavities extends into the hull of the boat. The cavities are positioned in spaced arrangement around the hull of the boat. Each of a plurality of inflatable bladders is positioned in an associated one of the cavities. Each inflatable bladder is coupled to the hull of the boat and is selectively inflatable wherein the inflatable bladders inhibit sinking of the boat when the inflatable bladders are inflated and extended from the hull. A trigger mechanism is operationally coupled to each inflatable bladder wherein actuation of the trigger mechanism deploys each inflatable bladder from the associated cavity and inflates each inflatable bladder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
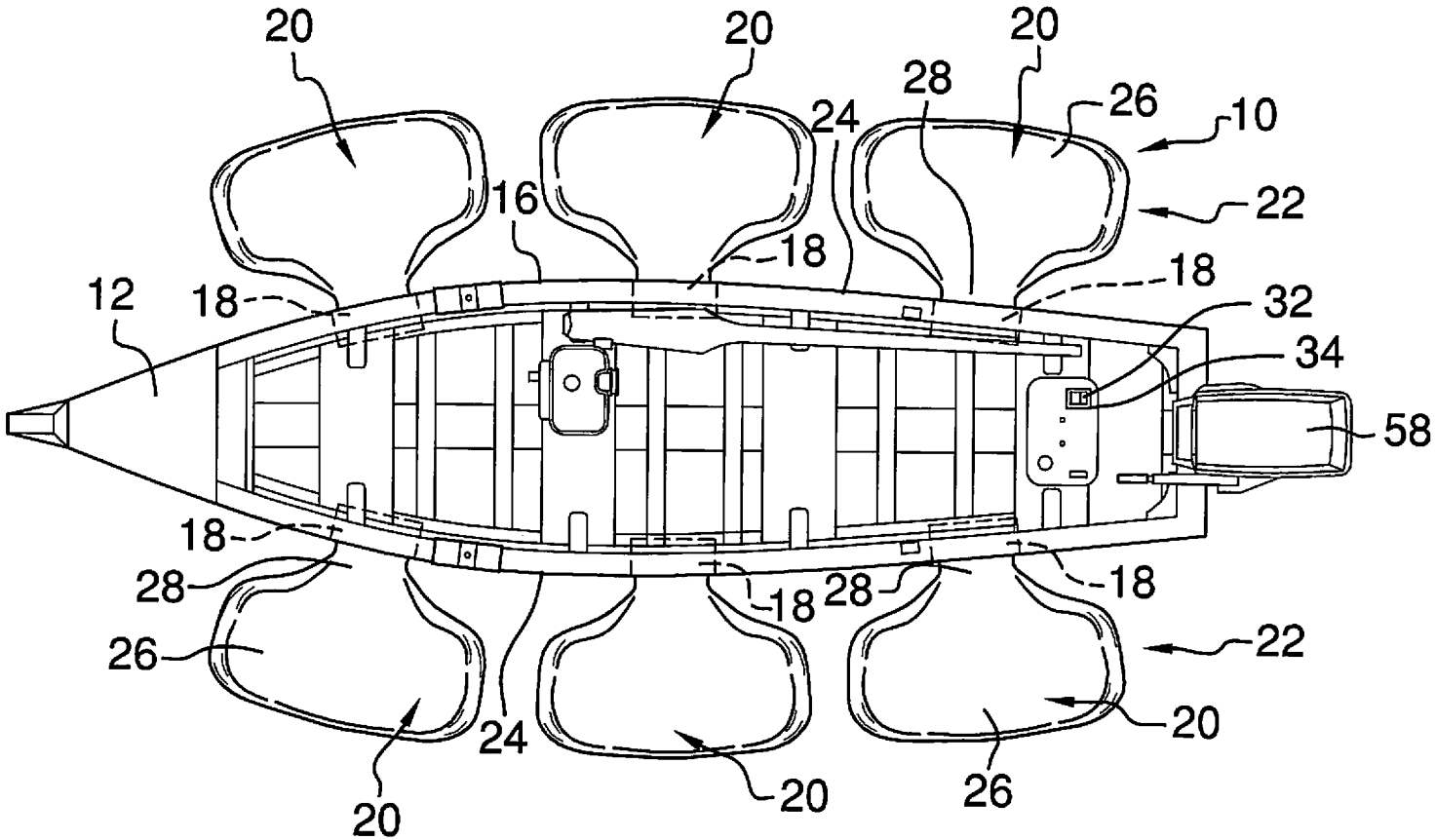
FIG. 1 is a top view of a power boat emergency floatation device according to an embodiment of the disclosure.
Figure 2:
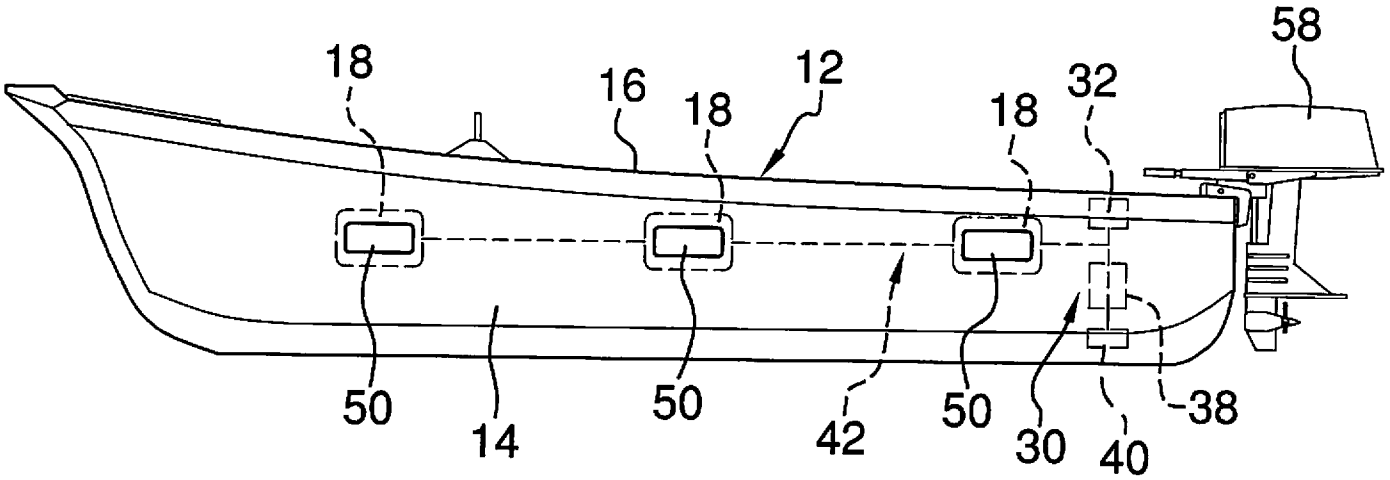
FIG. 2 is a side view of an embodiment of the disclosure.
Figure 3:
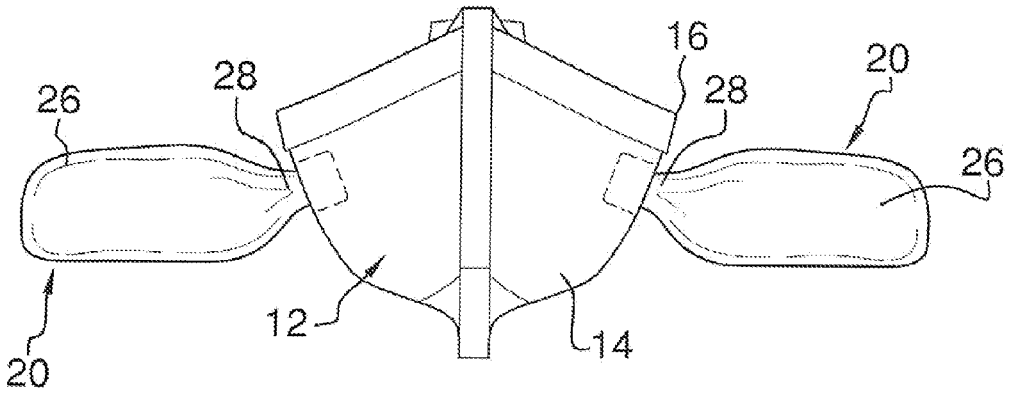
FIG. 3 is a front view of an embodiment of the disclosure.
Figure 4:
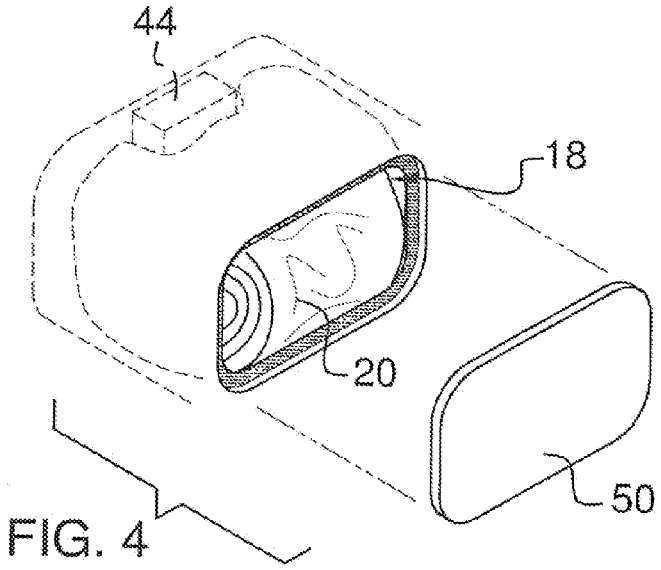
FIG. 4 is a partially exploded view of an embodiment of the disclosure.
Figure 5:
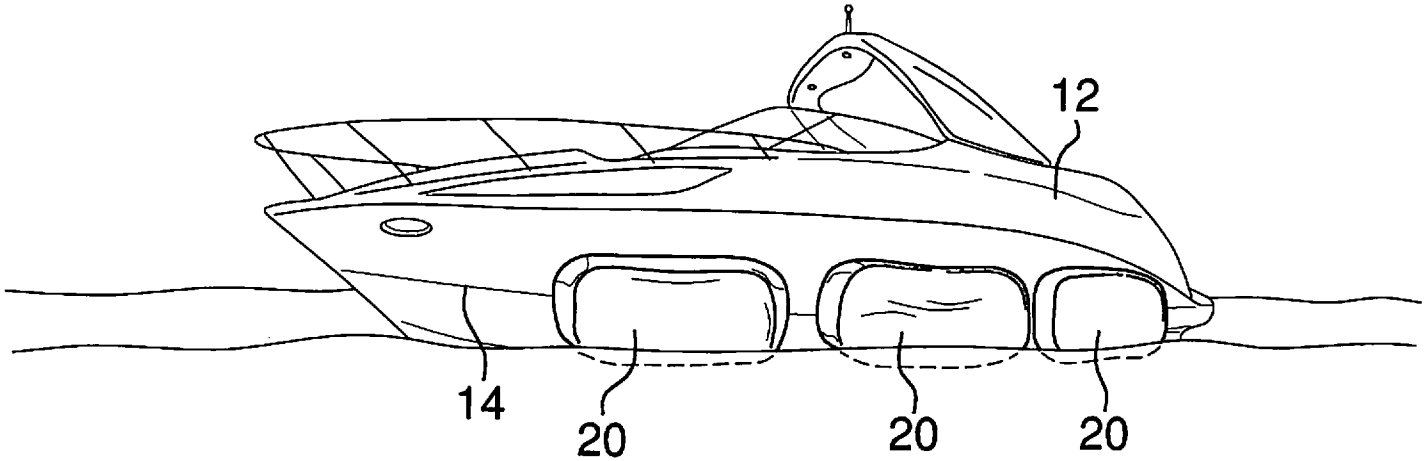
FIG. 5 is a side view of an embodiment of the disclosure in use.
Figure 6:
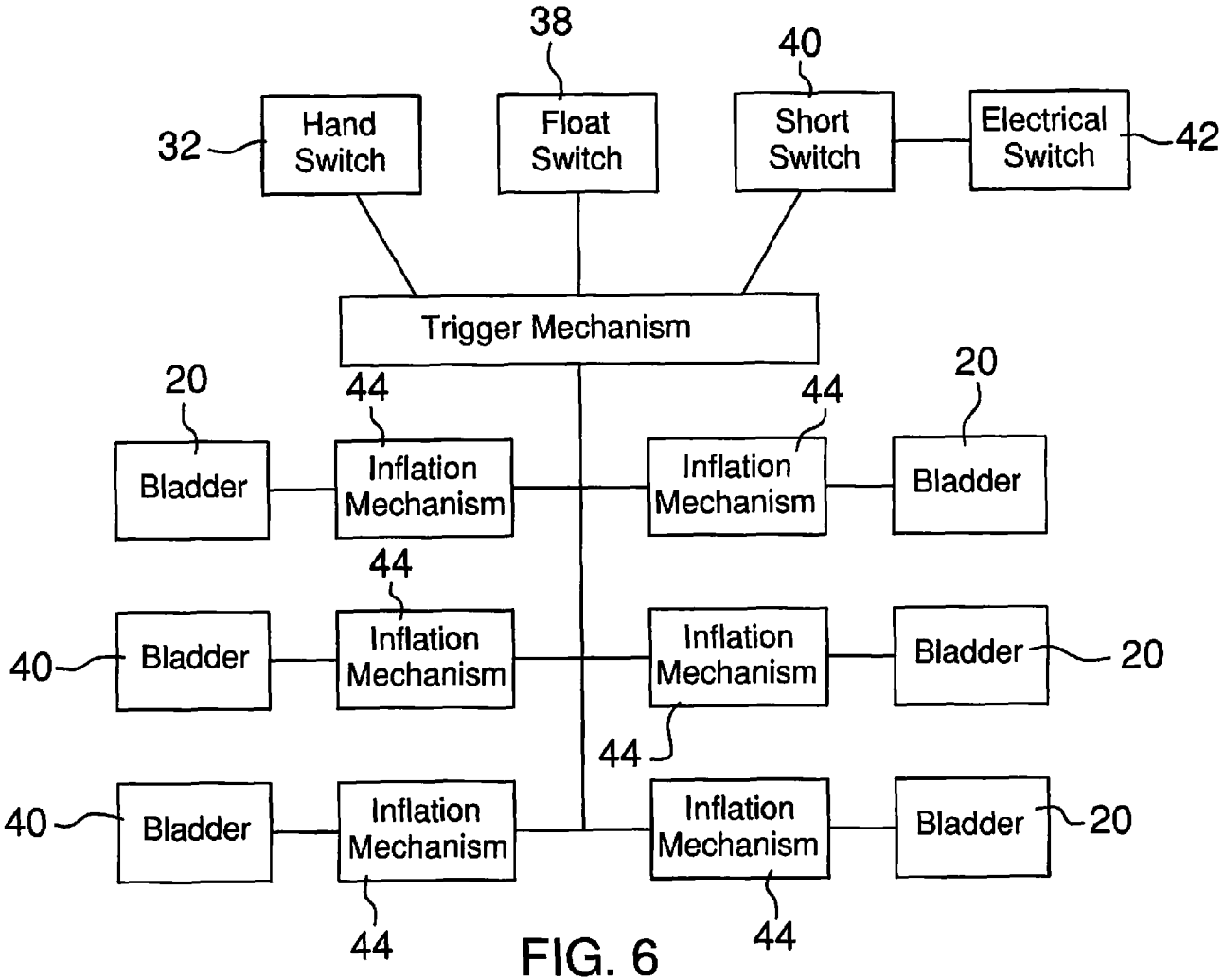
FIG. 6 is a schematic view of an embodiment of the disclosure.

With reference now to the drawings, and in particular to FIGS. 1 through 6 thereof, a new emergency floatation device embodying the principles and concepts of an embodiment of the disclosure and generally designated by the reference numeral 10 will be described.

As best illustrated in FIGS. 1 through 6, the power boat emergency floatation device 10 generally comprises a boat 12 having a hull 14. The hull 14 has an upper edge 16 extending around the boat 12. Each of a plurality of cavities 18 extends into the hull 14 of the boat 12 in spaced relationship below the upper edge 16 of the hull 14. The cavities 18 are positioned in spaced arrangement around the hull 14 of the boat 12.

Each of a plurality of inflatable bladders 20 is positioned in an associated one of the cavities 18. Each inflatable bladder 20 is coupled to the hull 14 of the boat 12. Each inflatable bladder 20 is selectively inflatable wherein the inflatable bladders 20 inhibit sinking of the boat 12 when the inflatable bladders 20 are inflated and extended from the hull 14. The inflatable bladders 20 may be arranged into two rows 22 with each row 22 extending along a respective lateral side 24 of the boat 12. Each inflatable bladder 20 has a bulbous main section 26 and a tapered neck section 28. The tapered neck section 28 extends between the hull 14 of the boat 12 and the main section 26 when the inflatable bladder 20 is deployed. The cavities 18 are aligned relative to the hull 14 such that the inflatable bladders 20 are configured for supporting the boat 12 in a substantially a horizontal plane when the boat 12 is being supported by the inflatable bladders 20 on a calm water surface. The cavities 18 and associated inflatable bladders 20 may also be aligned but positioned to support the boat 12 at a desired pitch or trim relative to a horizontal water surface depending on the particular shape of the hull 14.

A trigger mechanism 30 is provided. The trigger mechanism 30 is operationally coupled to each inflatable bladder 20 wherein actuation of the trigger mechanism 30 deploys each inflatable bladder 20 from the associated cavity 18 and inflates each inflatable bladder 20. The trigger mechanism 30 may comprise a hand operable switch 32 coupled to the boat 12 such that the hand operable switch 32 is configured for selective actuation by a person positioned in the boat 12. A cover 34 may be coupled to the boat 12 selectively covering the hand operable switch 32 wherein the cover 34 inhibits unintended actuation of the trigger mechanism 30 by bumping into or other accidental manipulation of the hand operable switch 32. The trigger mechanism 30 may alternatively or in combination with the hand operable switch 32 comprise a float switch 38 positioned on the boat 12 such that the float switch 38 is positioned to be actuated by water collecting within the boat 12. Thus, each inflatable bladder 20 is deployed upon detection of water collecting in the boat 12 by the float switch 38 without a user having to be aware that the boat 12 has begun to take on excessive amounts of water. The trigger mechanism 30 may further comprise alternatively or in combination with the previously described mechanisms, an electrical short detector 40 operationally coupled to an electrical system 42 of the boat 12. Thus, the electrical short detector 40 is actuated by detection of a short in the electrical system 42 of the boat 12 again providing an automated response without requiring a human response to deploy the inflatable bladders 20. Each of a plurality of inflation mechanisms 44 is positioned in an associated one of the cavities 18 and operationally coupled to an associated one of the inflatable bladders 20. Each inflation mechanism 44 is operationally coupled to the trigger mechanism 30 wherein each inflation mechanism 44 is actuated by the trigger mechanism 30. The inflation mechanism 44 may be a compressed gas container having a valve in fluid communication with the associated inflatable bladder 20 or may be constructed to produce sufficient gas to quickly deploy and inflate the inflatable bladder 20 in the same manner as a conventional air bag used in vehicles.

Each of a plurality of panels 50 is coupled to the hull 14 of the boat 12. Each panel 50 covers an associated one of the cavities 18 until the associated inflatable bladder 20 is deployed. Each panel 50 has an outer surface 52 positioned flush with an outer surface 54 of the hull 14 while the panel 50 is covering the associated cavity 18.

In use, the inflatable bladders 20 are manually or automatically deployed by actuation of the trigger mechanism 30 as needed to enhance buoyancy of the boat 12 and prevent the boat 12 from completely sinking. The boat 12 may include a motor 58 positioned in spaced relationship to the deployed inflatable bladders 20 wherein the motor may be used to attempt to steer and propel the boat 12 to safety after deployment of the inflatable bladders 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A power boat emergency floatation device comprising:

a boat having a hull, said hull having an upper edge extending around said boat;

a plurality of cavities, each cavity extending into said hull of said boat, said cavities being positioned in spaced arrangement around said hull of said boat;

a plurality of inflatable bladders, each said inflatable bladder being positioned in an associated one of said cavities, each said inflatable bladder being coupled to said hull of said boat, each said inflatable bladder being selectively inflatable wherein said inflatable bladders inhibit sinking of the boat when said inflatable bladders are inflated and extended from said hull; and a trigger mechanism, said trigger mechanism being operationally coupled to each said inflatable bladder wherein actuation of said trigger mechanism deploys each said inflatable bladder from said associated cavity and inflates each said inflatable bladder, said trigger mechanism comprising a float switch positioned on said boat such that said float switch is positioned to be actuated by water collecting within said boat whereby said each said inflatable bladder is deployed upon detection of water collecting in said boat by said float switch, said trigger mechanism comprising an electrical short detector operationally coupled to an electrical system of said boat wherein said electrical short detector is actuated by detection of a short in the electrical system of the boat.

2. The device of claim 1, further comprising said trigger mechanism comprising a hand operable switch coupled to said boat such that said hand operable switch is configured for selective actuation by a person positioned in said boat.

3. The device of claim 2, further comprising a cover coupled to said boat, said cover selectively covering said hand operable switch wherein said cover inhibits unintended actuation of said trigger mechanism.

4. The device of claim 1, further comprising a plurality of panels, each said panel being coupled to said hull of said boat, each said panel covering an associated one of said cavities.

5. The device of claim 4, further comprising each said panel having an outer surface flush with an outer surface of said hull while said panel is covering said associated cavity.

6. The device of claim 1, further comprising a plurality of inflation mechanisms, each inflation mechanism being positioned in an associated one of said cavities and operationally coupled to an associated one of said inflatable bladders, each said inflation mechanism being operationally coupled to said trigger mechanism wherein each said inflation mechanism is actuated by said trigger mechanism.

7. The device of claim 1, further comprising said cavities being aligned relative to said hull such that said inflatable bladders are configured for supporting said boat in a substantially a horizontal plane when said boat is supported by said inflatable bladders on a calm water surface.

8. The device of claim 1, further comprising each said inflatable bladder having a bulbous main section and a tapered neck section, said tapered neck section extending between said hull of said boat and said main section when said inflatable bladder is deployed.

9. The device of claim 1, further comprising said inflatable bladders being arranged into two rows, each row extending along a lateral side of said boat.

10. A power boat emergency floatation device comprising:

a boat having a hull, said hull having an upper edge extending around said boat;

a plurality of cavities, each cavity extending into said hull of said boat, said cavities being positioned in spaced arrangement around said hull of said boat;

a plurality of inflatable bladders, each said inflatable bladder being positioned in an associated one of said cavities, each said inflatable bladder being coupled to said hull of said boat, each said inflatable bladder being selectively inflatable wherein said inflatable bladders inhibit sinking of the boat when said inflatable bladders are inflated and extended from said hull, said inflatable bladders being arranged into two rows, each row extending along a lateral side of said boat, each said inflatable bladder having a bulbous main section and a tapered neck section, said tapered neck section extending between said hull of said boat and said main section when said inflatable bladder is deployed, said cavities being aligned relative to said hull such that said inflatable bladders are configured for supporting said boat in a substantially a horizontal plane when said boat is supported by said inflatable bladders on a calm water surface;

a trigger mechanism, said trigger mechanism being operationally coupled to each said inflatable bladder wherein actuation of said trigger mechanism deploys each said inflatable bladder from said associated cavity and inflates each said inflatable bladder, said trigger mechanism comprising a hand operable switch coupled to said boat such that said hand operable switch is configured for selective actuation by a person positioned in said boat, said trigger mechanism comprising a float switch positioned on said boat such that said float switch is positioned to be actuated by water collecting within said boat whereby said each said inflatable bladder is deployed upon detection of water collecting in said boat by said float switch, said trigger mechanism comprising an electrical short detector operationally coupled to an electrical system of said boat wherein said electrical short detector is actuated by detection of a short in the electrical system of the boat;

a plurality of inflation mechanisms, each inflation mechanism being positioned in an associated one of said cavities and operationally coupled to an associated one of said inflatable bladders, each said inflation mechanism being operationally coupled to said trigger mechanism wherein each said inflation mechanism is actuated by said trigger mechanism;

a cover coupled to said boat, said cover selectively covering said hand operable switch wherein said cover inhibits unintended actuation of said trigger mechanism;

a plurality of panels, each said panel being coupled to said hull of said boat, each said panel covering an associated one of said cavities, each said panel having an outer surface flush with an outer surface of said hull while said panel is covering said associated cavity.

* * * * *